US005351571A

United States Patent [19]

Johnson

[11] Patent Number: 5,351,571

[45] Date of Patent: Oct. 4, 1994

[54] ERGONOMICALLY SYMMETRIC PEDAL CONTROL SYSTEM

[76] Inventor: Robert E. Johnson, 201 Point East Dr., Nashville, Tenn. 37216

[21] Appl. No.: 944,053

[22] Filed: Sep. 11, 1992

[51] Int. Cl.[5] ..... G05G 9/00

[52] U.S. Cl. ..... 74/478; 74/479 ML; 74/562

[58] Field of Search ..... 74/478, 479 R, 479 ML, 74/479 MM, 482, 512, 514, 560, 562.5, 478.5; 200/86.5; 26/70; 112/217.3, 217.4

[56] References Cited

U.S. PATENT DOCUMENTS

| | | | |
|---|---|---|---|
| 2,589,975 | 3/1952 | Sprinkel et al. | 74/479 MM |
| 2,647,414 | 8/1953 | Nafe, Sr. et al. | 74/562.5 |
| 2,671,268 | 3/1954 | Crawford | 200/86.5 X |
| 2,983,347 | 5/1961 | Risk | 74/482 X |
| 3,134,270 | 5/1964 | Cole | 74/512 X |
| 3,224,294 | 12/1965 | Gresham | 74/562.5 |
| 3,282,123 | 11/1966 | Klingaman | 74/479 ML |
| 3,354,743 | 11/1967 | Strauss | 74/512 X |
| 3,980,848 | 9/1976 | Schulz et al. | 200/86.5 |
| 4,142,080 | 2/1979 | Takahashi | 200/86.5 |
| 4,152,951 | 5/1979 | Korczykowski | 74/479 MM X |
| 4,354,071 | 10/1982 | Pietschmann | 74/478 X |
| 4,586,398 | 5/1986 | Yindra | 74/512 |
| 5,067,368 | 11/1991 | Itakura et al. | 74/560 |

FOREIGN PATENT DOCUMENTS

| | | | |
|---|---|---|---|
| 360367 | 4/1906 | France | 74/512 |

*Primary Examiner*—Allan D. Herrmann
*Assistant Examiner*—David W. Laub
*Attorney, Agent, or Firm*—Greer Tipwell, Jr.

[57] ABSTRACT

An industrial machinery control system is provided which allows for ergonomically favorable operation by paired reciprocal control pedals which mirror an operator's right and left limbs. The reciprocal mirror control pedals allow operation of the same predetermined function within designated machinery by either the left or right foot of an operator, thus reducing fatigue while maintaining position at a particular workstation.

5 Claims, 2 Drawing Sheets

ERGONOMICALLY SYMMETRIC PEDAL CONTROL SYSTEM

REFERENCES CITED

| U.S. Patent Documents | | | |
|---|---|---|---|
| 4,354,071 | 10-12-92 | Pietschmann | U.S. Class No. 200/86.5 |
| 5,067,368 | 11-26-91 | Itakura, et al. | U.S. Class No. 74/560 |
| 4,586,398 | 5-6-86 | Yindra | U.S. Class No. 74/512 |
| 4,142,080 | 2-27-79 | Takahashi | U.S. Class No. 200/86.5 |

BACKGROUND OF THE INVENTION

1. Field of the Invention

The present invention relates to a control device operable by the user applying pressure to selected pedals to operate specified functions on connected machinery. By ergonomic design, the present invention allows control of the machinery operation by use of either foot to avoid fatigue and related operator errors.

2. Prior Art

There are several uses in industrial equipment operation, medical, and home utensil control apparatus which allow for control by depression of a pedal with the operator's foot. Various control devices have included the use of multiple pedals, each related to a separate function in the controlled device or which when operated together produced a desired function of the controlled device. However, especially where an operator has been required to stand during control of the device, all prior existing pedal control systems have led to significant musculoskeletal fatigue, inhibited circulation, lack of recuperation time, and have subjected operators to undue levels of unsupported stress in the knee, pelvic and ankle joints. When an operator's body is unevenly supported by an asymmetric lower limb, the supportive muscle around the joints tire quickly due to constant strain and lack of proper recovery time, therefore causing the stress load to shift onto the skeletal structure of the limb causing the operator to maintain a constant awkward posture. The operator's constant awkward posture causes unneeded musculoskeletal discomfort and fatigue, possibly tendonitis, osteochronditis, or arthritis.

Pedals for use in controlling machinery such as sewing machines have been used and one such pedal control system is disclosed in Itakura, et at., U.S. Pat. No. 5,067,368. Itakura shows a mechanism for sewing machine control, and in FIG. 2 of that patent, a control device with three separate pedals is shown indicating separate controls related to separate and distinct functioning operations. A mechanism for allowing plural pedal controls where two pedals are required to control two distinct functions but allowing an identical tactile feel in both pedals is disclosed in Pietschmann, U.S. Pat. No. 4,354,071. However, the structure and device disclosed in Pietschmann specifically relates to allowing each of multiple pedals to control separated functions in the equipment through a single electrical sensing element.

There are also numerous other pedal control devices showing multiple pedals in various arrangements to allow for control of specific, distinct operations of the machinery by actuation of each separate foot control. The art of machinery control devices does not disclose the use of pedals operable by either foot to control the same function in the controlled machinery. Yindra, U.S. Pat. No. 4,586,398 for multiple controls operable by shifting the operator's foot in a sideways motion; Takahashi, U.S. Pat. No. 4,142,080 for a foot controller of a surgical microscope with separate foot-operated controllers for various functions of a surgical microscope indicate the prior art. However, each of these pedal controls for machinery merely disclose the capability of controlling distinct functions with separate distinct pedal actuators, or each of these would require an operator to change his or her entire position in order to actuate a particular pedal with a different foot.

SUMMARY OF THE INVENTION

The present invention was conceived in response to a need for decreasing operator fatigue and resultant operator error related to the single-motion operation allowed by pedal control devices available in prior art. The solution to each single pedal operating a single function in the controlled machinery was solved by allowing a connected control system enabling the operator to control a particular or multiple particular machinery functions by use of either foot without requiring a move in position from a particular work station. Multiple linkage mechanisms and multiple equipment control mechanisms are available and adaptable to the invention, the essence of which is to provide an opportunity for a choice in and variations in limb selection for operation of a particular function. This allows an operator to vary throughout the working period their stance and combine rhythmic or random decisions related to which of the reciprocal control pedals are engaged, thus significantly controlling fatigue related to continual repetitious motions. The ergonomic pedal was designed to reduce or eliminate factors contributing to excessive trauma, injury or fatigue. Prior pedal controls require operators to shift their weight while operating. In the prior art, body weight is consistently on a particular side of the lower body, because the currently available design of pedal controls does not allow for the weight to be placed on the "pedal foot" without severe angular stress and discomfort on that respective ankle.

The combination of standing on one foot, and awkward movement of the other, can and will lead to a multitude of injuries such as phlebitis and varicose veins to name a few. The multiple-foot pedal is designed to allow the user to shift their feet when one is fatigued to the opposite side. This symmetrical pedal has many distinct ergonomic and economic advantages:

1. With the positioning of the front pedals, the weight of the body can be safely centered over both feet while simultaneously depressing the pedal to vary the speed of the machine.
2. This pedal is not dexterity-biased. The user can be a left-fooled or right-footed machine operator and still be 100% productive.
3. This pedal allows the user to shift weight by using two feet while sewing, or allow the user to swing his/her sewing foot to use both pedals with one foot.

The symmetrical design of the ergonomic sewing pedal is not dexterity biased, therefore allowing the operator to stay centered in correct posture while using discretion in rotating support to the rested limb as the body deems necessary. Just as an operator's heart requires rest between exertive contractions, so do his or her other muscles and lower extremities that are subject to constant tension and stress required by old industry methods. Our design provides the operator with frequent balanced rotations and rest, therefore promoting a natural physiological wellness. It has been determined that a working platform of wood and rubber provide therapeutic support and dual reciprocal controls promote proper balanced posture, needed musculoskeletal recovery and ergonomic safety. The sewing industry is realizing that stand-up sewing is more physiologically sound than the historic sit-down method, because proper posture is more natural when standing.

DESCRIPTION OF THE PREFERRED EMBODIMENT

Figure 1:
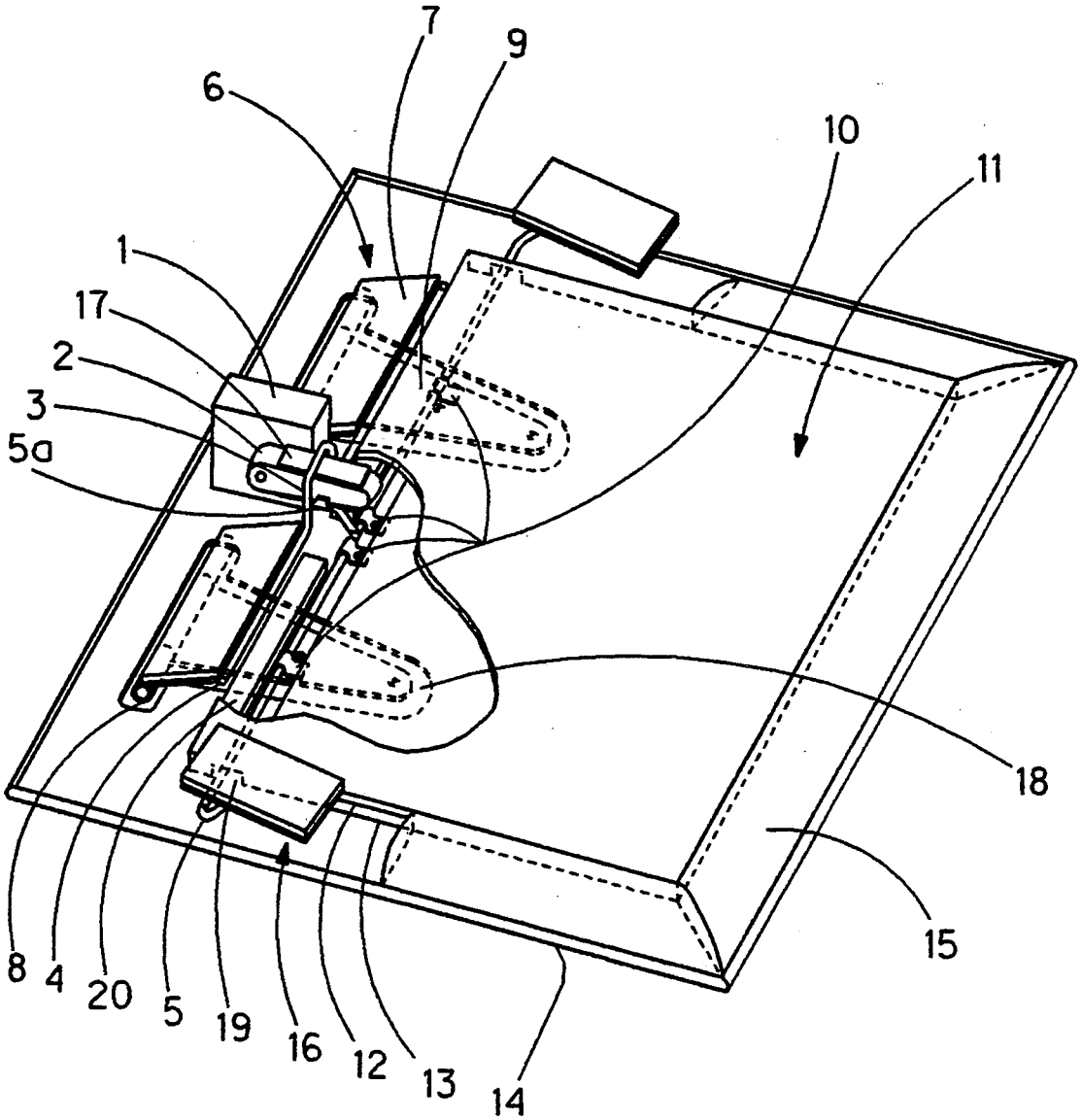
FIG. 1 is a perspective view of the symmetric pedal control system showing the integrated workstation and a cut-away section to reveal the operating linkage system.
Figure 2:
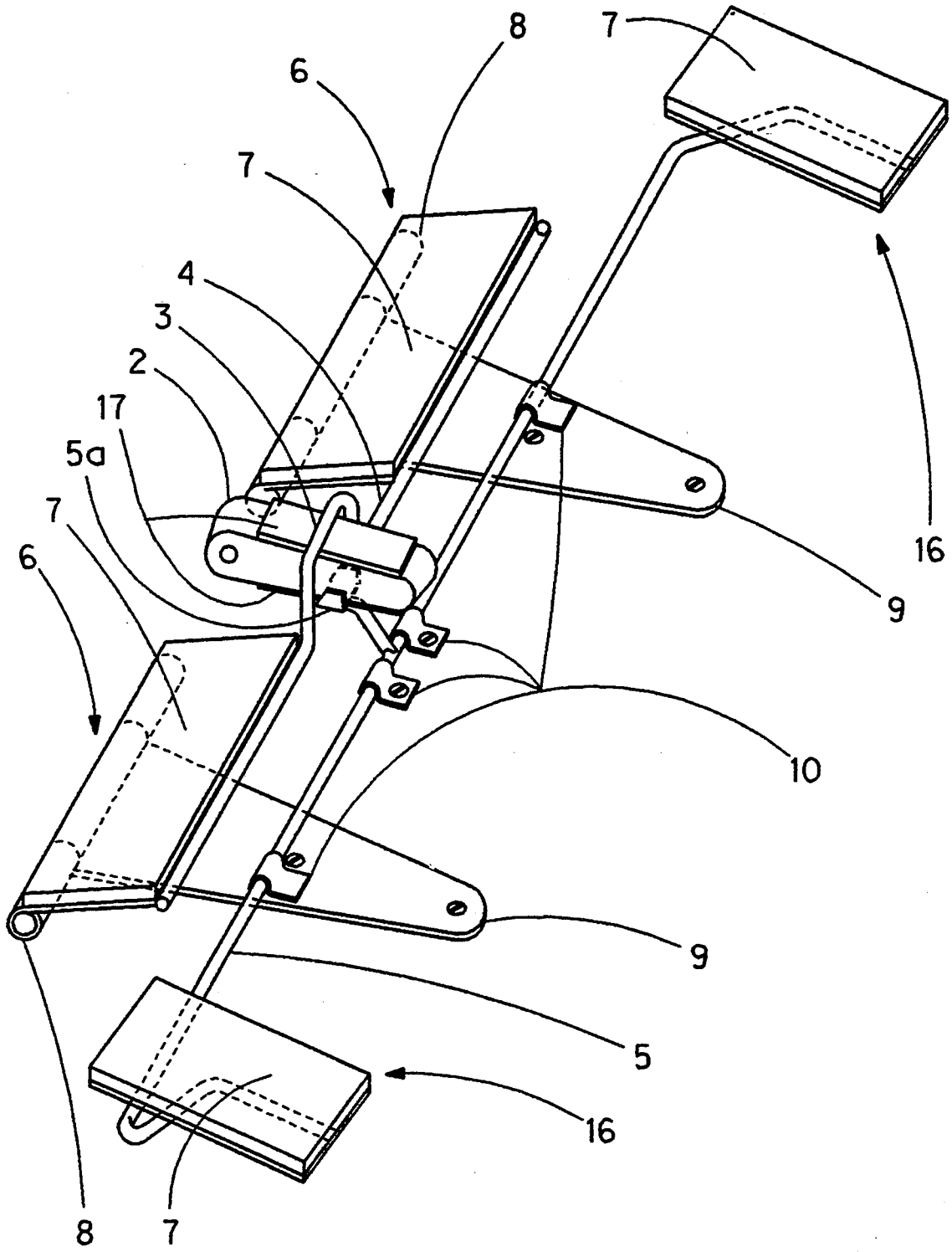
FIG. 2 is a perspective view of the pedals and associated actuation linkage without the integrated workstation platform.

As disclosed in FIGS. 1 and 2, one preferred embodiment, constituting an integrated system of the invention entails a platform which includes reciprocal pedal controls for operation of an industrial sewing machine. The system provides in one unit both a padded work station platform as well as ergonomically situated foot pedal controls operable with either the operator's left or right foot to control the sewing machine equipment. In the drawings, identical reference numerals denote identical or corresponding parts and these reference numerals are used in the following description of this preferred embodiment.

The preferred embodiment provides an integrated sewing machine workstation including a therapeutic workstation platform 11 with forward speed control pedals 6 and backtack and cut control pedals 16, which may be operated to actuate a signal lever arm 2. The signal lever arm 2 thus engages predetermined control commands through the means for communicating control demands 1 with a sewing machine through any of several function control signaling methods well known in the an of industrial machinery control, such as electric circuitry, mechanical switches, pressure sensitive buttons, or direct mechanical drives. The structure of the therapeutic workstation platform 11 is important in the integrated operation of the control pedals 6 and 16. The platform 11 provides a slightly elevated workstation which allows for comfortable pedal actuation while engaging the most prevalently used pedals, the forward speed controls 6. The operator's foot can maintain a flat position supporting his or her weight on the surface of the platform 11 as well as the pedal step surface 7 during the predominant pedal actuation position which is full speed forward sewing.

The platform 11 incorporates a non-slip padded work surface 12, a wooden structural base 13, and a non-slip floor contact 14 designed with recesses 18 for flush mounting of the pedal hinge bases 9. Also, a beveled workstation edge molding 15 is provided as a safety feature and a structural support for the integrated platform. Also, this edge molding 15 can be painted with a highly visible color to avoid accidental tripping and clearly demarcate the workstation. The forward speed control pedals 6 have an attached forward speed lever arm actuator rod 4 which transmits engagement of the pedal 6 through a contact bracket 3 to the signal lever arm 2. A protective lever arm contact covering 17 is provided to allow adaptation of the integrated control system with preexisting machinery control devices likely to be found already in place as a part of the industrial sewing machine. The linkage between the pedals 6 through the actuator rod 4 may be provided with a position return biasing device, such as a spring, not shown in the Figures provided since the preferred embodiment is shown here attached to a sewing machine that includes a preexisting spring loaded signal lever arm prevalent in the prior art. The forward speed control pedal 6 includes a pedal step surface 7 usually made of non-slip surface; a pedal hinge 8 providing a rotatable connection with the pedal hinge base 9.

As an integrated structure, the wooden structural base 13 includes a forward pedal actuation stop 20 that defines a channel and is integrated in height with the pedal 6 and the work surface 12 to provide an even surface between the top of the pedal step surface 7 and workstation surface 12 when the pedal 6 is fully engaged during the predominant period of operation. Adjustment of signal lever arm 2 actuation at the position where the step surface 7 and the workstation surface 12 are level is controllable through the shape of the link between the forward speed lever arm actuator rod 4 and the forward speed lever arm contact bracket 3. In this embodiment, the forward speed control pedal 6 is engagable to control through an infinite range of forward sewing from initial engagement to the desired, predetermined full-speed rate of sewing.

A second operation in the industrial sewing control provided by the preferred embodiment includes the backtack and cut operation whereby the control reverses the sewing direction for a predetermined distance, lifts the fabric guide foot, and performs an automatic cut of the sewing thread. These operations of the sewing machine are not shown as they are prevalent in the prior art. However, what is depicted as pan of this preferred embodiment is the provision of reciprocal backtack and cut control pedals 16. The backtack pedal structure 16 includes a pedal step surface 7 which engages a backtack and cut lever arm actuator rod 5 providing rotation along this rod which is transmitted as a distinct control of the signal lever arm 2 through a backtack and cut lever arm contact bracket **5*a*. The rotation of the backtack actuator rod 5 is aligned within actuator rod bearing brackets 10 holding the rod within the channel 19 formed between the front edge of the structural base 13 and the back edge of the forward speed pedal actuation stop 20**.

The foregoing description is intended merely to portray one structural mechanism in one industrial control setting whereby the present invention is employed. This preferred embodiment reveals several favorable features of the invention, including the ability to design a control system using the invention with relatively simple mechanical apparatus, and the ability to link the invention with preexisting means for communicating control demands with particular machinery. Also, this preferred embodiment entails the advantages of an integrated control workstation and includes not only the ergonomic design of a symmetric pedal control system but also the ergonomic advantage of a flat supporting operating surface during tim predominant control engagement position.

What is claimed is:

1. A machinery control system comprising:

a) a base;

b) a control pedal system connected to said base having a reciprocally matched pair of pedal sets and a means for generating a control signal from each pedal of said sets such that corresponding pedals in the reciprocally matched pair of pedal sets send the same control signal to a means for communicating said control signal to said machinery; and c) a platform mounted on said base having a support structure that supports an operator such that said reciprocally matched pair of pedal sets are disposed adjacent to and about said platform in a mirrored image fashion.

2. A machinery control system according to claim 1, wherein said pedals of said reciprocally matched pair of pedal sets are arranged so that when operated a top surface of said pedal is aligned approximately even with said support surface of said platform.

3. A machinery control system according to claim 1, wherein said means for communicating said control signal to said machinery is un umbilical connection operable with various types of machinery.

4. A machinery control system according to claim 1, wherein said platform is sized to allow engagement of pedals in one set of said reciprocally matched pair of pedal sets by one of the feet of said operator and engagement of pedals in the other set of said reciprocally matched pair of pedal sets by the other foot of said operator.

5. A machinery control system according to claim 1, wherein the pedals or certain pedals in said reciprocally matched pair of pedal sets have a contact surface defining the place of engagement by the feet of said operator which is slanted toward said base and located adjacent to an edge of said platform so that particular pedals can be engaged in a range of positions.

* * * * *